United States Patent [19]

Sulcs

[11] Patent Number: 5,055,740

[45] Date of Patent: Oct. 8, 1991

[54] HORIZONTAL BURNING METAL HALIDE LAMP

[75] Inventor: Juris Sulcs, Chagrin Falls, Ohio

[73] Assignee: Venture Lighting Interntional, Inc., Solon, Ohio

[21] Appl. No.: 18,468

[22] Filed: Feb. 25, 1987

[51] Int. Cl.[5] ..... H01J 61/30

[52] U.S. Cl. ..... 313/634; 313/621; 313/623

[58] Field of Search ..... 313/634, 623, 44, 621

[56] References Cited

U.S. PATENT DOCUMENTS

| | | | |
|---|---|---|---|
| 3,858,078 | 12/1974 | Koury | 313/634 |
| 3,963,951 | 6/1976 | Ramberg | 313/44 |
| 4,001,623 | 1/1977 | Howles et al. | 313/634 |
| 4,232,243 | 11/1980 | Rigden | 313/634 X |
| 4,281,267 | 7/1981 | Johnson | 313/44 X |
| 4,307,315 | 12/1981 | Meulemans et al. | 313/634 X |
| 4,498,027 | 2/1985 | Karlotski et al. | 313/634 |

FOREIGN PATENT DOCUMENTS

| | | | |
|---|---|---|---|
| 0053062 | 3/1982 | Japan | 313/634 |
| 1522036 | 8/1978 | United Kingdom | 313/634 |
| 1579030 | 11/1980 | United Kingdom | 313/623 |
| 1591617 | 6/1981 | United Kingdom | 313/634 |

*Primary Examiner*—Donald J. Yusko
*Assistant Examiner*—Michael Horabik
*Attorney, Agent, or Firm*—Rogers & Killeen

[57] ABSTRACT

An arc tube for a horizontally burning metal halide lamp having electrodes disposed below the axis of a generally cylindrical arc tube with an asymmetric pinch about the electrodes.

29 Claims, 2 Drawing Sheets

HORIZONTAL BURNING METAL HALIDE LAMP

BACKGROUND OF THE INVENTION

The present invention relates to horizontal burning metal halide lamps with improved efficiency and improved color qualities.

It is well known that a dramatic difference exists in the color qualities of the light produced as a function of the vertical or horizontal positioning of metal halide arc lamps used for general lighting applications When such lamps are mounted in the preferable horizontal position, the arc tends to bow upwardly, tending to overheat the upper part of the arc tube and to create a cold spot along the bottom of the arc tube. The overheating tends to reduce the life of the arc tube and to degrade both the intensity and quality of color over the life of the lamp.

Metal halides tend to condense in the cold spots because of the temperature differential between the upper and lower regions of the arc tube. This condensation decreases the vapor pressure of the various elements of the lamp fill material which determine the color of the lamp, resulting in degradation of intensity and color quality.

The generally known prior art has attempted to accommodate the problem of a bow in the arc in several ways. One such approach has been the use of an electromagnetic field to hold the arc in a horizontal position. This approach generally results in a complex structure and has not found favor because of increased size and expense.

In another prior art approach such as disclosed in the Koury U.S. Pat. No. 3,858,078 dated Dec. 31, 1974 and the Karlotski, et al., U.S. Pat. No. 4,498,027 dated Feb. 5, 1985, the arc tube is arched to effectively center the arc tube about the bowed arc. However, the arch in the tube increases the effective diameter of the arc tube and thus the lamp, making the lamp unsuitable for many compact fixtures. The use of an arched tube also creates cold spots at both ends in the regions behind the electrodes, and the necessity for arching the tube increases the complexity and cost of manufacturing the lamp.

Still other known approaches, as disclosed for example in the Rigden U.S. Pat. No. 4,232,243 dated Nov. 4, 1980, and Howles, et al., U.S. Pat. No. 4,001,623 dated Jan. 4, 1977, lower the elevation of the electrodes within the arc tube to provide additional room for the upward bowing of the arc in the operation of the lamp. While lowering the electrodes reduces the overheating of the arc tube at its upper extremity and raises the temperature in the lower region, it generally does not raise the temperature of the lower regions of the arc tube sufficiently to obviate the problem of lamp fill condensation and associated reduction in vapor pressures particularly at the cold spots below and behind the electrodes at both ends of the arc tube.

In addition, the placement of the electrodes within the lower portion of the arc tube of the traditional symmetrical pinch design is difficult to control in manufacturing, and any tilting of the arc tube from a position other than horizontal creates wide variances in the color temperature of the discharge. Further, some of the metal halides typically condense at the cold spots in the seam of the pinch below the electrodes creating problems with the seam. Thus, lamp designs with lowered electrodes have not achieved a great deal of commercial success.

In attacking the cold spot problem, it is a common practice in metal halide arc discharge lamps to apply heat reflective coatings to the ends of the arc tube to reduce condensation of lamp fill material behind the electrodes. As disclosed for example in the Johnson U.S. Pat. No. 4,281,267 dated July 28, 1981, this heat reflective coating on the ends of an arched arc tube may be reduced in the area behind the electrodes in the upper surface of the tube to reduce the internal reflections and increase the upward exposure of a greater portion of the arc.

As disclosed in the Ramberg U.S. Pat. No. 3,963,951 dated June 15, 1976, a longitudinal stripe of heat reflective material also may be provided along the bottom of the arc tube to reduce condensation of the metal halides in the center thereof at the farthest distance from the upward bow in the arc. The use of such coatings is helpful in the elimination of the cold spots but does not impact on the hot spot problem. As earlier explained, the arched tube may require a larger diameter envelope and a corresponding larger fixture.

In another prior art approach to the cold spot problem, and in lieu of a coating, the arc tube may be constructed out of an ultraviolet absorbing quartz glass over the lower portion thereof. Such construction is disclosed, e.g., in the Meulemans, et el., U.S. Pat. No. 4,307,315 dated Dec. 22, 1981. While the temperature of the lower portion of the lamp is increased, this approach does not obviate the hot spot at the top of the lamp. In addition, multiple glass arc tubes are difficult to manufacture and relatively expensive.

It is, accordingly, an object of the present invention to obviate these and other problems of the known prior art horizontal burning metal halide lamps, and to provide a novel metal halide lamp for general lighting applications.

Another object of the present invention is to provide a novel horizontal burning metal halide lamp with greater efficacy and improved color uniformity.

Yet another object of the present invention is to provide a novel metal halide lamp less sensitive to changes in the position of the lamp from the horizontal.

A further object of the present invention is to provide a novel horizontal burning metal halide lamp with the electrodes lowered within the arc tube.

A still further object of the present invention is to provide an arc tube for a horizontal burning lamp with novel shapes and dimensions of the end chamber.

Yet a further object of the present invention is to provide a novel arc tube for a horizontal burning lamp with the cold spot located along the lower wall of the arc tube between the electrodes.

These and many other objects and advantages of the present invention will be readily apparent to one skilled in the metal halide lamp art upon a perusal of the claims and the following detailed description when read in conjunction with the appended drawings.

THE DRAWINGS

THE DETAILED DESCRIPTION

Figure 1:
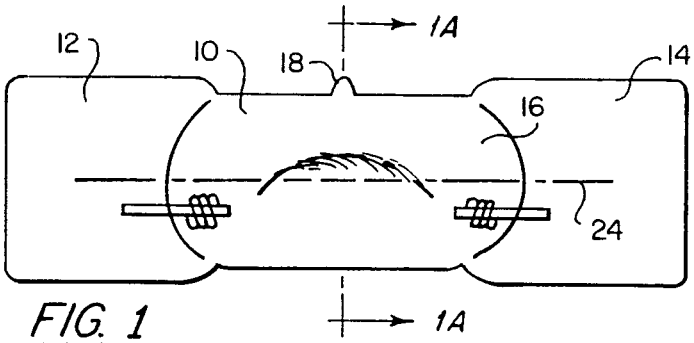
FIG. 1 PRIOR ART
FIG. 1 is a side view of a conventional arc tube with electrodes offset below the axis of the arc tube.
Figure 1A:
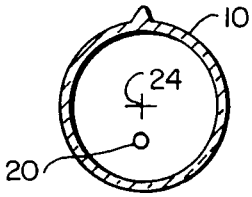
FIG. 1A PRIOR ART
FIG. 1A is a section taken through lines 1A—1A of FIG. 1.
Figure 2:
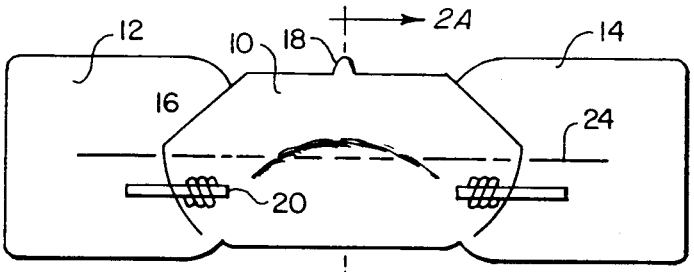
FIG. 2 PRIOR ART
FIG. 2 is a side view of a prior art arc tube with a modified pinch seal and end chamber shape.
Figure 2A:
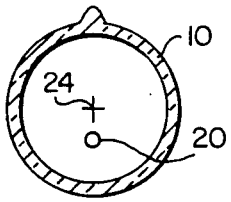
FIG. 2A PRIOR ART
FIG. 2A is a section taken through lines 2A—2A of FIG. 2.
Figure 3:
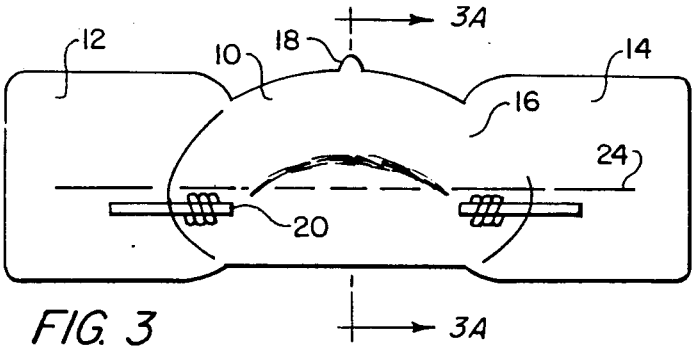
FIG. 3 PRIOR ART
FIG. 3 is a side view of a prior art arc tube showing a modification of the shape of the top portion of the arc tube.
Figure 3A:
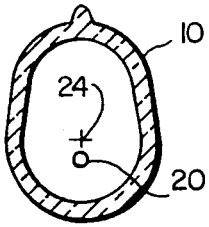
FIG. 3A PRIOR ART
FIG. 3A is a section taken through lines 3A—3A of FIG. 3.
Figure 4:
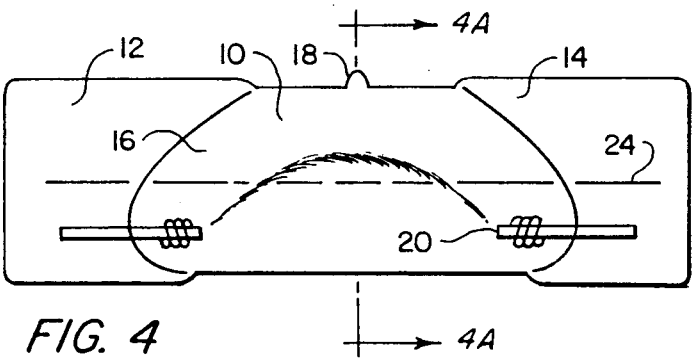
FIG. 4 is a side view of an embodiment of an arc tube constructed in accordance with the present invention.
Figure 4A:
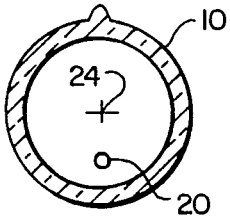
FIG. 4A is a section taken through lines 4A—4A of FIG. 4.
Figure 5:
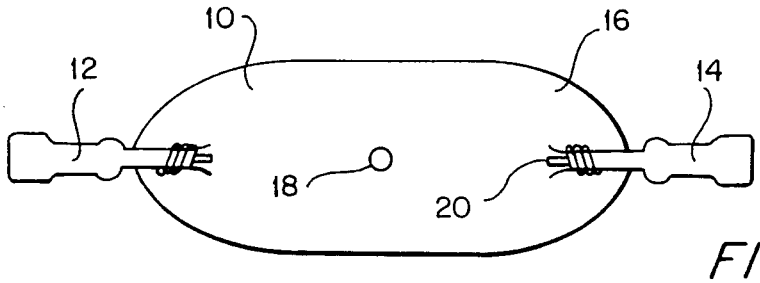
FIG. 5 is a top plan view of the arc tube of FIG. 4.

FIGS. 1, 2, and 3 depict prior art arc tube and FIGS. 4 and 5 show a preferred embodiment of the present invention. All of the illustrated arc tubes include a tube 10 of fused silica, generally cylindrical in shape and closed at their opposite ends by press seals 12 and 14. These press seals form the end chambers 16 to the discharge space within the arc tube. In an arc tube with a cylindrical shape, the open end of the end chambers is defined by the departure of the internal surface thereof from the surface of the cylinder, i.e., the plane of first reduction in cross-sectional area.

Each of the arc tubes has an exhaust tip-off 18 formed by removal of an exhaust tube and sealing off during manufacturing process. The two discharge electrodes 20 are positioned at opposite ends of the tube in the end chambers 16. As may be easily seen from the figures, the electrodes 20 are located below the axis 24 of the cylinder of the tubes of FIGS. 1, 2, and 4, and below the axis 26 of the cylindrical bottom portion of the arc tube of FIG. 3.

As also may be easily seen by a comparison of the prior art illustrated in FIGS. 1–3 to the preferred embodiment of the present invention illustrated in FIG. 4, the arc tube 10 of the present invention is cylindrical and therefore does not require any special forming or shaping of the silica.

In addition, the electrodes 20 may be positioned a greater distance below the cylindrical axis 24 of the arc tube 10 thereby increasing the temperature in the lower regions thereof. The electrodes 20 are centered in the extreme ends of the relatively narrow end chambers 16 to allow maximum clearance for the insertion of the electrode 20 into the end chamber greatly simplifying control of electrode placement during manufacture.

Note that the upper surface of the end chamber 16 is approximately equal distance from the bowed arc formed between the electrodes 20 when the lamp is in operation. The proximity of the lower portion of the end chamber 16 to the electrode 20 prevents a cold spot from forming behind or below the electrode and the slope of the lower portion of the end chamber intersects the lower portion of the arc tube cylinder beyond the free end of the electrode. A more uniform wall temperature throughout the discharge space results with the cold spot centered along the lower portion of the arc tube cylinder between the electrodes where it is more easily controlled. Greater uniformity of color is achieved even when the arc tube is tilted from the horizontal at an angle of up to as much as forty degrees.

Figure 6:
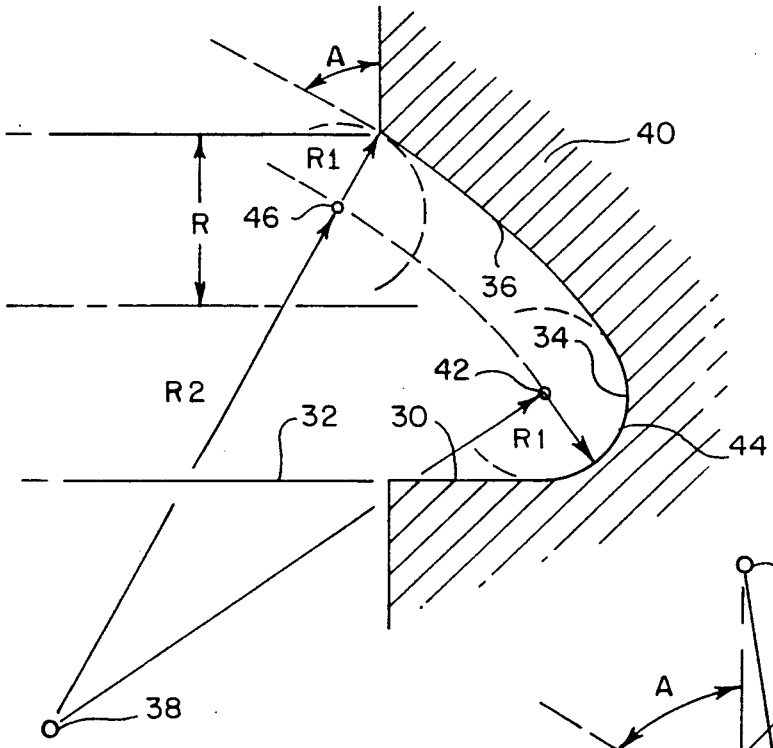
FIG. 6 is a section in elevation of a first jaw for pinching the arc tube to form an end chamber.

As shown in FIG. 6, the shape of the end chambers in a vertical cross-section through the cylindrical axis of the tube may be formed by three portions, i e , a straight line portion 30 continuing the lower wall of the tube 32, a second portion 34 formed by the arc of a circle of relatively small radius R1 and a third portion 36 formed by the arc of a circle of relatively large radius R3 drawn from first center 38 displaced in the plane of the vertical cross section below the lower wall 32 of the arc tube.

Figure 7:
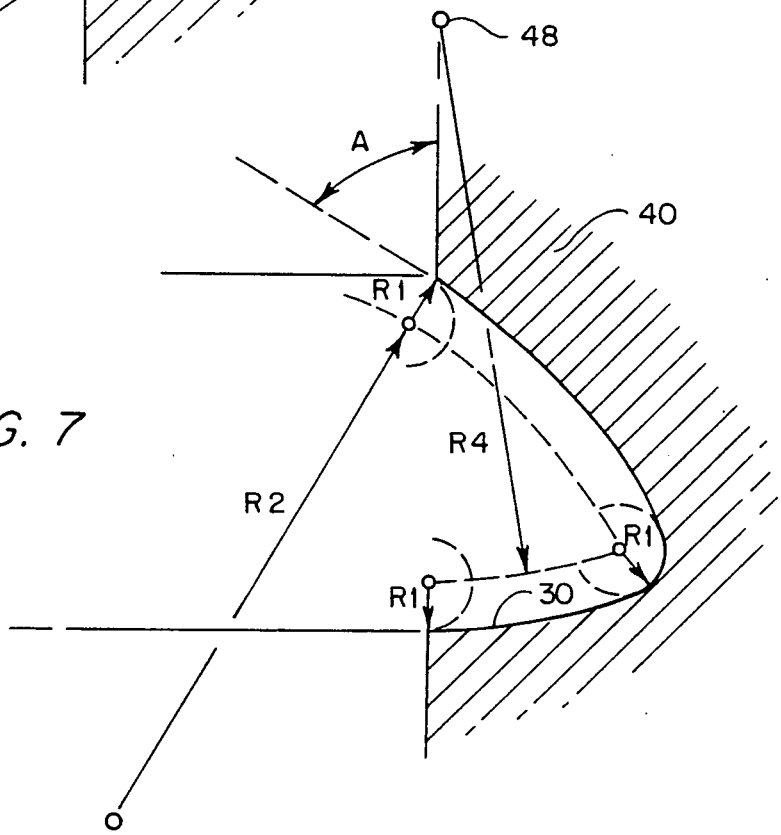
FIG. 7 is a section in elevation of a second jaw for pinching the arc tube to form an end chamber.

Jaws for pressing quartz seals and forming such end shapes can be made as simple profiles as shown in FIGS. 6 & 7. A roughly circular cross section perpendicular to the axis of the arc tube can be maintained with careful control of the temperature of the quartz and the internal pressure of the arc tube at the instant the seal is pressed closed. A preferable method is to provide a fully molded end shape to simplify manufacture, reduce material losses in manufacture and provide the tightest possible control of geometrical tolerances.

For practical reasons a roughly circular cross section perpendicular to the axis of the arc tube is desired. However, choosing an exactly circular cross section (only excepting the press seal seams) leads to a surprisingly simple method for fabricating press seal jaws that provide fully molded end shapes. This is an important economic consideration, in that press seal jaws wear with use and are often made from materials that are expensive and difficult to fabricate. Alternatively less expensive jaw materials can be employed with reduced wear capabilities if the labor cost of fabrication is lowered by use of simple manufacturing methods.

In one such method, a rectangular block of jaw material, after a cavity is formed for the end shape, will be parted in the plane of the profiles of FIGS. 5 & 6 to form a pair of press seal jaws that will mold the arc tube end shape. The tools required are a ball end cutter of radius R1; a boring tool to hold the cutter from the center of the tool to a radius offset from the center of the tool nearly equal to the quartz tube radius; and by way of example, a milling machine to turn the boring tool on a vertical axis, and with a table to hold the jaw material and move in a vertical and at least one horizontal direction. To implement a particular design, R1 can be chosen considering the dimensions of the tube, the desired electrode offset and practical limitations of tolerances that can be achieved for a particular press seal operation, with the smallest practical value being preferred. If R1 is smaller than half the offset, the design of FIG. 7 is preferred. Next the depth of the jaw cavity must be chosen considering the amount of quartz that can be heated for a particular tube diameter and the desired intrelectrode spacing Angle A can then be chosen with angles in the range of 75 to 45 degrees providing satisfactory end shapes for a wide range of arc tube designs.

As apparent from the figures, FIG. 6 is a special case of FIG. 7 where R4 is infinite and R1 is equal to the electrode offset.

The trajectory of the boring tool axis in a vertical plane half way between the circular segments formed by radii R1 & R2, and the appropriate boring tool radial setting at a particular point along the axis can then be calculated and it has been found that a table of 20 to 40 increments will provide a very smooth shape and require 1 to 2 hours of labor from a reasonably skilled machinist to form a cavity.

While a preferred embodiment of the present invention has been described, other variations and modifications will naturally occur to those skilled in the art from a perusal hereof. It is therefore to be understood that the embodiment described is illustrative only, and that the scope of the invention is to be defined solely by the appended claims when accorded à full range of equivalents.

What is claimed is:

1. In a metal halide arc discharge lamp for operation in a generally horizontal position including an arc tube comprising a generally cylindrical tube with closed end chambers of continuously reducing cross-sectional area and electrodes in the end chambers below the cylindrical axis of the arc tube, the improvement wherein the greatest length of said arc tube is at the elevation of said electrodes.

2. The lamp of claim 1, wherein the upper surface of the end chambers conforms generally to the bow in the arc between the electrodes when the lamp is operating.

3. The lamp of claim 2, wherein the lower surface of said end chambers is downwardly curved to intersect the cylindrical portion of said arc tube at a point below or forward of the free end of said electrodes so as to prevent the formation of a cold spot behind or below said electrodes in the operation of the lamp.

4. The lamp of claim 3, wherein the shape of said end chambers is asymmetrical.

5. The lamp of claim 4, wherein said end chambers are provided with a heat reflective coating.

6. The lamp of claim 5, wherein said arc tube is provided with a heat reflective coating along the length thereof in the vertical plane of said electrodes.

7. The lamp of claim 2, wherein said arc tube has a heat reflective coating on said end chamber and along the bottom thereof.

8. The lamp of claim 1, wherein the lower surface of said end chambers is downwardly curved to intersect the cylindrical portion of said arc tube at a point below or forward of the free end of said electrodes so as to prevent the formation of a cold spot behind or below said electrode in the operation of the lamp.

9. The lamp of claim 8, wherein said end chambers are provided with a heat reflecting coating.

10. An arc tube for an arc discharge lamp comprising a cylindrical tube of fused silica pinched at opposite ends to form asymmetrical closed end chambers, said end chambers having a smoothly reducing cross-sectional area from the open to the closed end thereof; and a pair of electrodes between which the arc is established in the operation of the lamp, said electrodes being located one each in the end chambers at the point of greatest length of the arc tube, the open end of said end chambers extending at least as far forward as the free end of said electrodes.

11. The lamp of claim 10, wherein said end chambers are provided with a heat reflective coating.

12. The lamp of claim 11, wherein said heat reflective coatings are asymmetrical.

13. The lamp of claim 10, wherein the asymmetry of the end chambers is in a first plane;

wherein the displacement of said electrodes from the axis of said tube is in said first plane in a first direction; and wherein said end chambers extend forward further in said first plane in the direction opposite to said first direction than it does in said first direction.

14. The arc tube of claim 13, wherein said heat reflective coatings are asymmetrical.

15. An arc tube for an arc discharge lamp comprising a generally cylindrical tube of fused silica pinched at opposite ends to form asymmetric curved end chambers of continuously reducing cross-sectional area;

a pair of spaced electrodes mounted one each in said end chambers generally parallel to the cylindrical axis of said tube, said end chambers extending toward each other at least as far as the free ends of said electrodes.

16. The arc tube of claim 15, wherein said end chamber are asymmetrical.

17. The arc tube of claim 16, wherein the upper internal surface of said tube approximates the curvature of the arc between said electrodes in the normal operation of said arc tube, and wherein the junction of the internal upper surface of said generally cylindrical tube with said end chambers forms a nonacute angle.

18. The arc tube of claim 17, wherein said junction of the internal lower surface of said generally cylindrical tube with the curve of said end chambers is approximately tangential.

19. The arc tube of claim 16, wherein said junction of the internal lower surface of said generally cylindrical tube with the curve of said end chambers is approximately tangential.

20. The arc tube of claim 15, wherein said electrodes are below the cylindrical axis of said tube in the normal operation of the arc tube.

21. The arc tube of claim 20, wherein said electrodes are coaxial and disposed below the axis of said tube.

22. The arc tube of claim 21, wherein said end chambers are provided with a heat reflective coating.

23. An arc tube having an end chamber in which all sections normal to the cylindrical axis of said tube are circles;

in which the radius of said circles becomes progressively smaller from the open end to the closed end of said end chambers; and in which all of said circles between the open end of said end chambers and a plane spaced from the closed end of said end chambers a distance equal to the radius of the one of said circles in said plane are tangential to one wall of said tube 24. The arc tube of claim 23 wherein said circles are tangent to the lower wall of said arc tube.

25. An arc tube having an end chamber defined in longitudinal cross section by a first portion linearly continuing the lower wall of the arc tube, a second portion continuing the upper wall of the arc tube and forming an arc having a radius not less than twice the depth of the end chamber about a point in the plane of said longitudinal cross-section, displaced below the lower wall of the arc tube a distance approximately that of the depth of the end chamber, and a third portion connecting said first and second portion and forming the arc of a circle having a radius less than 50% of the depth of said end chamber.

26. In an arc tube having electrodes extending into end chambers defined in longitudinal cross section by three curves, the improvement where the electrode intersects the middle curve at approximately ninety degrees 27. The arc tube of claim 26 wherein the middle curve is an arc of a circle 28. A generally tubular arc tube having end chambers wherein the closed end thereof is generally spheriod and electrodes extending into said end chambers generally parallel to the axis of said tube but displaced therefrom, said electrodes being substantially normal to said end chambers at the point of entry.

29. The arc tube of claim 28 wherein the radius of said spheroid is approximately one-half of said displacement.

* * * * *